United States Patent [19]

Chase et al.

[11] 4,024,295

[45] May 17, 1977

[54] COATING PROCESS UTILIZING PROPELLED PARTICLES

[75] Inventors: Curtis L. Chase, Oakdale; William R. Lovness, West St. Paul, both of Minn.

[73] Assignee: Minnesota Mining and Manufacturing Company, St. Paul, Minn.

[22] Filed: Apr. 7, 1975

[21] Appl. No.: 565,712

[52] U.S. Cl. ..... 427/47; 427/192; 427/217; 427/216

[51] Int. Cl.[2] ..... B05D 3/14; B05D 7/00

[58] Field of Search ..... 427/47, 184, 192, 216, 427/217, DIG. 8; 118/76; 209/38, 226; 51/163 R, 163 V, 164, 164.5; 241/68; 259/99, DIG. 46

[56] References Cited

UNITED STATES PATENTS

| | | | |
|---|---|---|---|
| 944,997 | 12/1909 | Abbe | 51/164.5 |
| 2,600,367 | 6/1952 | Stirn et al. | 51/164 |
| 2,640,002 | 5/1953 | Clayton | 427/192 |
| 2,689,808 | 9/1954 | Clayton | 427/217 |
| 2,723,204 | 11/1955 | Pottberg et al. | 427/192 |
| 3,173,664 | 3/1965 | Isaacson et al. | 51/163 |
| 3,570,184 | 3/1971 | Ferrara | 51/164 |
| 3,774,888 | 11/1973 | Isaacson | 51/163 |
| 3,848,363 | 11/1974 | Lovness et al. | 51/317 |
| 3,892,908 | 7/1975 | Lovness | 259/99 |

*Primary Examiner*—Ronald H. Smith
*Assistant Examiner*—S. Silverberg
*Attorney, Agent, or Firm*—Cruzan Alexander; Donald M. Sell; Richard Francis

[57] ABSTRACT

A coating process, whereby particulate material is coated onto a solid substrate surface by exposing the surface in a confined volume containing impact media mixed with the particulate material and propelling the impact media at a velocity sufficient to cause the particulate material to adhere to the surface, is improved by reducing the relative amount of certain undesirable fine particles which may be produced during the coating operation. The improvement is especially useful in a coating process wherein the impact media are small permanent magnet elements which are propelled by a moving magnetic field.

5 Claims, 2 Drawing Figures

COATING PROCESS UTILIZING PROPELLED PARTICLES

BACKGROUND OF THE INVENTION

This invention relates to a process for coating various particulate materials onto the surface of solid substrates.

DESCRIPTION OF THE PRIOR ART

The process of mechanical plating has been known for perhaps a quarter of a century. The broad principles of the process are well known; see, e.g., British Pat. No. 534,888, U.S. Pat. No. 2,689,808, and U.S. Pat. Re. No. 23,861, and other publications. The process is typically carried out by placing in a tumbling barrel metallic parts to be plated, plating metals in the form of minute malleable particles, impact media such as glass beads and cullet, water, and, optionally, a chemical promoter. As the tumbling barrel is rotated, the plating metal particles are hammered against the surface of the metallic parts to be plated, the impact media and the parts themselves serving to flatten the metal particles into a continuous coat.

Mechanical plating may also be accomplished by projecting an airborne mixture of coatable particles and hard peening particles onto a substrate causing hammering of the coatable particles on the surface as a layer.

U.S. patent application, Ser. No. 373,028, filed June 25, 1973, now U.S. Pat. No. 3,892,908 discloses a process for coating solid substrates with any of a variety of particulate materials. The process involves exposing the surface of the substrate in a confined volume containing impact media in the form of small magnet elements which is mixed with the particulate material and establishing, within an effective distance of the confined volume, a magnetic field varying in direction with time. The process has wide utility and has been found to be useful for coating any of a wide variety of substrates with any of a wide variety of particulate materials.

SUMMARY OF THE PRESENT INVENTION

Applicants have discovered that the impact media used to propel the coatable particulate material in the previously described coating processes fractures to produce minute fragments which will become coated with this material and these coated fragments interfere with the coating process. They have further discovered that these processes may be improved by reducing the relative amount of coated impact media fragments which are produced during the coating process.

Reduction of the relative amount of coated impact media fragments in the coating process surprisingly improves the quality of the coating, making some otherwise marginally acceptable coatings into excellent quality coatings. Equally surprisingly, miniminizing the presence of such fragments increases the rate of coating, reducing the time required by as much as 50% or more. Even 10% reduction in the total weight of such fragments has been found to provide substantial improvement in the process. The greatest improvement is noted when the reduction is on the order of at least 20%.

Reduction of the relative amount of these fragments may be accomplished either by physically removing at least a portion of them as they are formed during the coating operation or by inhibiting their formation. Note should be taken of the fact that it is presently almost impossible to remove or prevent the formation of all of these fragments. Separation of the fragments from the mixture of impact media, parts being coated and coatable powder may be accomplished by conventional particle separation means, e.g., by screening.

The size of the fragments which has been found to be detrimental is generally less than about 10% the average diameter of the impact media, although this may vary from batch to batch depending upon the size of the substrate being coated, the size of the impact media, and the size of the coatable particulate material.

The formation of the fragments can be inhibited, quite surprisingly, by the addition of solid thermoplastic resins to the mixture of impact and coatable particulate material. While not completely understood, these additive materials are thought to have a slight lubricating effect on the particle mixture which reduces fracturing of the impact media.

BRIEF DESCRIPTION OF THE DRAWINGS

The two figures of the drawing further illustrate the invention. Like reference numerals in the figures identify the same elements.

DETAILED DESCRIPTION OF THE INVENTION

Figure 2:
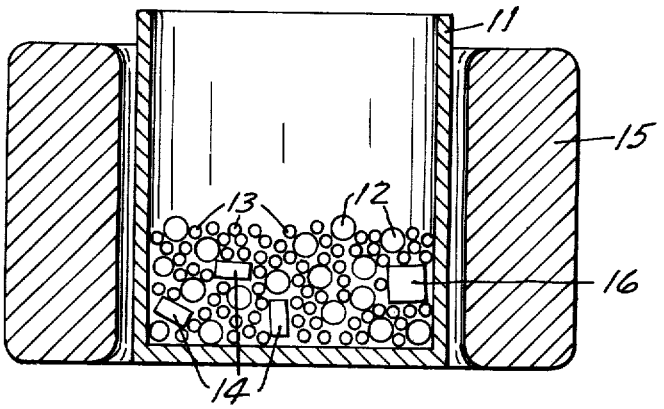
FIG. 2 is a sectional view of another embodiment of such apparatus.

FIG. 2 shows a coating apparatus comprising a vessel 11 which contains impact media 12, coatable particulate material 13, articles 16 being coated, and additive particles 14 and a means 15 for imparting movement in the impact media. If the process is mechanical plating, impact media 12 will be glass beads, cullet or any material known for such use and means 15 will comprise a shaker, tumbler or other means for achieving suitable mechanical agitation. The previously cited references dealing with mechanical plating will provide sufficient detail for these and other conventional elements for mechanical plating equipment, process conditions and the like.

Where the process utilizes magnetic forces to propel the impact media, means 15 comprises an electrical element capable of producing a magnetic field which varies in direction with time and impact media 12 comprise small permanent magnet elements capable of being moved by the magnetic field.

The thermoplastic resins which have been found useful in inhibiting the fragmentation of impact media are solids at room temperature and may be resins such as polyvinyl chloride, polyethylene, polyamide (e.g., nylon), polypropylene, polyurethane elastomer, acrylate polymer, polypropylene/acrylic acid ionomer, polyester, tetrafluoroethylene polymer (e.g., "Teflon") and polysulfone. These thermoplastic materials may be either in the form of chips, powder, or other regular or irregular shaped small particles, or in the form of rods or other shapes which may project into the interior of container 11 or 21 as an integral part thereof.

Excessively soft thermoplastic resins which will smear the surface of the substrate being coated should be avoided because they will inhibit coating rather than improve the process. Thermoplastics having a softening point above about 100° C have been found to function quite well without smearing, the softening point being hereinafter defined.

The quantity of additive material required to adequately inhibit the formation of impact media fragments is inversely related to the particle size of the additive. Where the additive is of a very small particle size (e.g., 600 microns in average diameter or less), the weight of additive will be a small percentage of the weight of impact media, e.g., 0.1 – 5%. Where the particle size exceeds above 600 microns in average diameter, more additive may be required, e.g., from about 5 to about 100%, or more, of the weight of the impact media.

Figure 1:
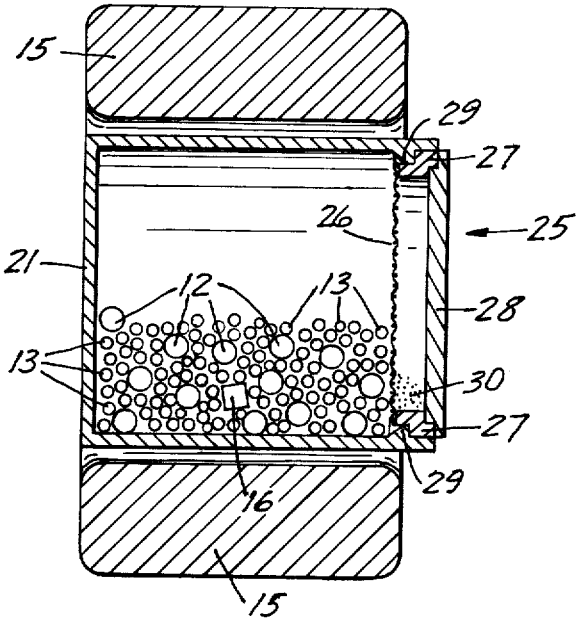
FIG. 1 is a vertical sectional view of a coating apparatus in accordance with the invention.

The coating apparatus of FIG. 1 includes equipment for removing part of impact media fragments which are formed during its operation. A simple form of such equipment may be made by modifying a conventional coating apparatus to include a screen or other perforate element 26 in position to contact impact media 12 during the coating operation. The preferred equipment for this purpose is a particle removal and collection assembly 25 which comprises a perforate element 26 fastened to adaptor ring 27, which in turn is fastened to optionally removable cover 28, forming a closed particle collection chamber 30. Perforate element 26 may be formed of screen, foraminous metal plate, or other member having openings sized to pass fragment 30 and prevent the passage of the unbroken impact media 12. Particle removal and collection assembly 25 is fastened to one end of container 21 by suitable flange 29 such that, as the particles within the container are propelled, some portion of their mass will contact some portion of the perforate element 26 to provide an opportunity for the fragments 30 to pass into collection chamber 27. For this purpose, container 21 is usually operated in the horizontal position, as shown.

The perforate element 26 or the interior walls of the container 21 may also be fitted with means for diverting the flow of the particulate material to obtain better contact of this material with the element 26 and therefore improve the removal efficiency. Such means may be by use of diversion vanes, plates, ridges or the like.

The components of the coating system utilizing magnetic energy (e.g., the magnetic field generating means, permanent magnet elements, etc.) are described in detail in aforementioned U.S. Ser. No. 373,028, the disclosure of which is incorporated herein by reference. Briefly, as described in that application, the magnetic field may be generated by means of any device known to produce a magnetic field which can vary in direction with time, such as by means of air or metal core coils, stator devices or the like. The preferred means for generating the magnetic field is capable of generating a rotating magnetic field wherein the field rotates about a central axis defined by the device itself. The preferred means for this purpose is described in U.S. Pat. No. 3,848,363, the disclosure of which is also incorporated herein by reference. This means has at least four overlapping electrical coils arranged in a generally circular pattern of opposed pairs and is energized by two or more out-of-phase sources of alternating currents so that opposed coils are of opposite magnetic polarity and of the same phase.

The interior of the container or surface for confining the magnetic elements and a particulate coating material within a predetermined area should be a non-magnetic material such as glass, synthetic organic plastics, for example, polytetrafluoroethylene (e.g., Teflon), polyethylene, polypropylene, and the like, ceramics, non-magnetic metals such as stainless steel, bronze, lead, etc. As previously mentioned, the container itself may provide the source of the additive material by certain modifications in its inner surface. For example, the container may be formed of a thermoplastic resin (which is known to inhibit fragmentation) with integral projections of the same material extending into its interior.

Any one of a variety of particulate materials of varying degrees of hardness and shape is contemplated for use as the coating material. For the most part, the coating materials are metal powders but other materials have also been found suitable. Further illustrative coatable powders are disclosed in aforementioned U.S. Ser. No. 373,028.

The shape of the particulate material being coated is not critical, and the size may range from 0.1 micron or less in maximum dimension to several hundred microns or more.

The following examples illustrate the invention.

EXAMPLE I

MAGNETIC COATING

To illustrate the improvement obtained by the invention in a coating process utilizing small permanent magnet elements as impact media and a moving magnetic field as a means of propelling the impact media, the following equipment was utilized to perform the operations described thereafter.

DEVICE FOR GENERATING ROTATING MAGNETIC FIELD

The device for generating the rotating magnetic field was a ring-like structure, having an inner diameter capable of accommodating the container hereinafter described, with copper wire windings forming three pairs of overlapping opposed coils, so that opposed coils were of opposite magnetic polarity. The container was a stainless steel cylinder, 10.8 cm long and 14.7 cm in diameter which was closed at the bottom end and open at the top. The bottom of the container had an external coupling adapted to fit within a corresponding coupling located at the bottom of the opening in the magnetic field generating device which was mechanically connected to a drive means for rotating the container at a predetermined speed.

The magnetic field generating device was operated at 440 volts three phase AC, approximately 3.6 to 4 amperes, 60 HZ, with the container rotating at 15 revolutions per minute. When magnetizable mild steel balls were to be coated, the magnetic field was pulsed on for 14 seconds and off for 1 second to permit the balls, which tend to clump together under the induced magnetic field, to move with respect to one another and thus preclude the existence of uncoated portions thereon.

Magnet elements

The magnet elements which were 1–3 mm average diameter barium ferrite particles having a coercivity of 3000 oersteds and a magnetization of 70 gauss per gram, had been magnetized by brief exposure to an applied magnetic field of 10,000 gauss.

Coatable particulate material

The coatable particulate material was atomized powdered aluminum sold under the trade designation "AMPAL 631", having a particle size of about 13±8 microns.

Thermoplastic material

The additive thermoplastic material for this example consisted of cylindrical pellets approximately one-eighth inch in diameter and one-eighth inch long, formed of medium density polyethylene resin having a softening point of 114.5° C and sold under the trade designation "Gulf" No. 2604.

Substrate

The substrate being coated was the surface of several mild steel balls approximately one-half inch in diameter and weighing approximately 8.3 grams per ball.

Coating thickness was measured using a beta backscatter gauge, e.g., Model MD-3 sold by Unit Process Assemblies, Inc., a conventional instrument for measuring the thickness of thin films.

Coating brightness was determined by visual inspection, with numerical ratings from 0 - 10 assigned. A rating of zero means the coating surface had a bright silvery surface while a rating of 10 indicates a gray matte surface, with intermediate ratings having brightnesses between these extremes.

In a control run, 750 grams of magnet elements, 20 grams of aluminum powder and 500 steel balls were placed into the container and the magnetic field generating device was activated for a period of 15 minutes. The coating operation was then discontinued, an additional 10 grams of aluminum powder added, and the operation resumed for an additional 15 minutes. The balls were then removed and the aluminum coating on the steel balls examined and measured for thickness. The coating was good quality, with a brightness of 6 and a thickness of 11.6 microns.

In a subsequent run for the same period of time under the same conditions except for the addition of 10 grams of polyethylene pellets, the coating was excellent, with a brightness of 1 and a thickness of 16.3 microns.

Table I below summarizes the results of the previously described control and Examples 1–6. Examples 2–6 follow the procedure of Example 1 except for replacement of the additive material with that indicated in the table. As shown in Table I, the additive had the effect of reducing the relative amount of fragments (called "fines" in the Table), increasing the coating thickness and improving its brightness.

In the Table, the term Fines means that percent of the impact media which passes through a 40 mesh (U.S. Standard) screen based upon the initial weight of the impact media. The term "Quantity" is that weight percent of thermoplastic resin added to the particle mixture based upon the initial weight of impact media.

Table I

| Example No. | Additive Type | Softening Point, (° C) | Particle Size, in. | Quantity, (%) | Fines (%) | Coating Thickness (Microns) | Brightness |
|---|---|---|---|---|---|---|---|
| Control | none | — | — | — | 3.6 | 11.6 | 6 |
| 1 | polyethylene[1] | 114.5 | ⅛ | 1.3 | 2.2 | 16.3 | 1 |
| 2 | methyl methacrylate[2] | 166 | ⅛ | 1.3 | 2.2 | 16.5 | 3–4 |
| 3 | polypropylene[3] | 128 | ⅛ | 0.8 | 2.4 | 14.7 | 3–4 |
| 4 | polyvinyl chloride | 130 | ⅛ | 1.3 | 2.6 | 12.9 | 2 |
| 5 | polyamide[4] | 190 | ⅛ | 1.3 | 2.9 | 12.4 | 5 |
| 6 | urethane elastomer[5] | 163 | ⅛ | 1.3 | 2.9 | 12.6 | 4 |

[1]Medium density polyethylene, sold under the trade designation "Gulf" 2604.
[2]Sold under the trade designation "Lucite" 140.
[3]Sold under the trade designation "Profax" 6329.
[4]Nylon 6.
[5]Sold under the trade designation "Texin" 355D.

EXAMPLE 7

A simulated mechanical plating operation was carried out by adhering a one-half inch by 1 inch by one-sixteenth inch (1.6 gram) copper piece onto the inside of a plastic cover of a 100 cc glass vial, placing 75 grams of unmagnetized barium ferrite of the type described in Example 1 and 1.5 grams of the aluminum powder as also described in Example 1 into the vial and shaking the vial on a mechanical shaker with movement having a 2½ inch horizontal amplitude and five-eighth inch vertical amplitude at 2100 strokes per minute for a period of 30 minutes. Thereupon, the control sample was removed, visually inspected and weighed to determine the % weight gain. The same experiment was repeated with the addition of 0.1 gram of 525 micron average diameter polyethylene (sold under the trade designation "Microthene"). Results are tabulated below:

Table II

| Run Conditions | Weight Gain (%) | Brightness |
|---|---|---|
| Without additive | 0.35 | 8 |
| With additive | 2.55 | 3 |

EXAMPLE 8

Following the procedure of Example 7, except using 25 grams of one-fourth inch diameter glass beads and 25 grams of 0.2 inch diameter glass beads in place of the unmagnetized barium ferrite, the following results were obtained:

Table III

| Run Conditions | Weight Gain (%) | Brightness |
|---|---|---|
| Without additive | 0.27 | 8 |
| With additive | 0.58 | 3 |

EXAMPLE 9

Using the apparatus described in Example 1, including the device for generating rotating magnetic field, magnet elements, and coatable particulate material, but modifying the equipment according to that shown in FIG. 1 by operating it in a horizontal position with a 40 mesh (U.S. Standard) brass screen over the opening of the container, the following coating operation was carried out. Seven hundred fifty grams of magnet elements, 20 grams of aluminum powder and 50 steel balls were placed into the container and the screen cover fastened in place. The magnetic field generating device was activated for a period of 15 minutes whereupon the coating operation was discontinued. An additional 10 grams of aluminum powder was added and the operation was continued for an additional 15 minutes. The balls were then removed and the aluminum coating visually inspected and measured for thickness. The thickness was 15 microns and the brightness 5. Without using the screen, the thickness was 11 and the brightness 6.

Screening the contents of the container revealed 2.7% fragments of the initial weight of the barium ferrite particles, when the screen was not used. The screen removed 33% of the total weight of these fragments during the coating operation.

Softening Point Determination

The softening point of the thermoplastic resins is determined by spreading particles of the material being tested along a calibrated Kofler Heizbank Reichert type 7841 hot bench (previously warmed up for one-half hour) having graduated temperature increases from 60° to 260° C along its length. The softening point is taken as that temperature at which the thermoplastic particle maintained its original shape, permanently deformed under probe pressure, and yet remained intact when spreading was attempted.

What is claimed is:

1. In a process for coating particulate material upon the surface of a solid substrate comprising:

exposing said substrate surface in a confined volume containing impact media in the form of a small permanent magnetic elements and said particulate material, and propelling said impact media by a magnetic field which varies in direction with time at a velocity sufficient to cause the particulate material to impinge upon and to coat said exposed substrate surface;

the improvement which comprises physically removing at least 10% the relative weight of coated impact media fragments normally produced without said improvement during said coating by having in effective communication with said confined volume a perforated element which has openings of a size sufficient to receive impact media fragments and to exclude said impact media and said particular material.

2. The process of claim 1 wherein said particulate material is aluminum powder.

3. The process of claim 1 wherein said solid substrate is steel.

4. The process of claim 1 wherein said magnetic field rotates upon a central axis.

5. The process of claim 1 wherein said magnetic elements are barium ferrite.

* * * * *